United States Patent [19]

Sargunam

[11] Patent Number: 4,593,677

[45] Date of Patent: Jun. 10, 1986

[54] RANGE GRATE AND RETAINING CLIP ASSEMBLY

[75] Inventor: Issac P. Sargunam, Ontario, Calif.

[73] Assignee: Magic Chef, Cleveland, Tenn.

[21] Appl. No.: 759,841

[22] Filed: Jul. 29, 1985

[51] Int. Cl.[4] ..... F24C 15/06

[52] U.S. Cl. ..... 126/214 C; 126/215; 126/39 R; 126/211

[58] Field of Search ..... 126/39 R, 39 B, 42, 126/81, 211, 212, 221, 220, 261, 268, 265, 266, 262, 214 C, 215, 50, 152 R

[56] References Cited

U.S. PATENT DOCUMENTS

| | | | |
|---|---|---|---|
| 2,764,970 | 10/1956 | Caroni | 126/214 C |
| 3,170,457 | 12/1965 | Bucellato | 126/214 C |
| 3,416,513 | 12/1968 | Fischer et al. | 126/215 |
| 4,261,327 | 4/1981 | Kamin | 126/211 X |

*Primary Examiner*—Larry Jones

*Attorney, Agent, or Firm*—Bacon & Thomas

[57] ABSTRACT

A range grate and retaining clip assembly for detachable engagement over the burner well of a range top provided with a pair of openings spaced on opposite sides of the burner well, the grate including a pair of linearly disposed arms, each arm being provided at its terminal end with a pair of downwardly directed projections for insertion through a corresponding opening, the projections of one arm having a pair of inwardly directed flanges, whereby such projections may be engaged by a channel-shaped portion carried by the clip, the latter being formed of spring metal and engageable against the upper surface of the range top in the inner edge surface of the corresponding opening to permit the grate to be shifted laterally towards the opposite opening for insertion of the other projections therethrough.

7 Claims, 7 Drawing Figures

RANGE GRATE AND RETAINING CLIP ASSEMBLY

BACKGROUND OF THE INVENTION

1. Field of the Invention

The present invention generally involves the field of technology pertaining to a grate utilized for supporting articles over the burner well of a range top. More particularly, the invention relates to an improved grate and means for detachably securing the grate to the range top.

2. Description of the Prior Art

It is well known to provide means for detachably securing a grate in place over the burner well of a range top in order to prevent the grate from rattling due to vibration or being accidentally dislodged from the range top. The purpose of such securing means is particularly important when gas ranges or stoves are utilized in a vehicular environment, such as within trailers, mobile homes, campers and other types of similar vehicles. This is because movement of the vehicle during travel often imparts significant vibration to the cooking appliance, thereby causing the individual grates to rattle and possibly dislodge from their positions over the burner wells.

There have been many different prior art attempts to solve the problem of constraining a grate to a range top so that it is securely attached thereto and yet easily detached therefrom if desired for cleaning or other purposes. For example, the Bucellato U.S. Pat. No. 3,170,457; Kamin U.S. Pat. No. 3,263,676; and Fischer et al U.S. Pat. No. 3,416,513 all teach the use of clips for securing a grate or heating plate onto the top of a range. The Ondrasik U.S. Pat. No. 4,089,321 teaches that grate vibration and accidental dislodgement may be prevented by providing the grate with downwardly extending projections which lock within corresponding apertures formed through the stove top. Other variations of these types of securing means are also conventional and well known in the overall state of the art pertaining to this field of technology.

SUMMARY OF THE INVENTION

It is an object of the present invention to provide an improved means for detachably securing a range grate in position over the burner well of a range top.

It is another object of the invention to provide an improved retaining clip for securing a range grate to a range top wherein the grate is prevented from rattling or accidental dislodgement.

It is a further object of the invention to provide an improved range grate and retaining clip assembly which is simple in construction, economical to manufacture and easy to install.

The foregoing and other objects of the invention are realized by providing a range grate that is at least partially defined by a pair of linearly disposed arms, each of which terminates in a pair of downwardly extending projections, with each pair of projections being insertable through a corresponding opening formed in the range top. The pair of projections associated with one arm is provided with a pair of inwardly directed flanges for permitting a channel-shaped portion carried by one leg of a U-shaped retaining clip to engage the projections and secure the clip to the grate. The clip is made of spring metal and provided with a second leg which is defined by first and second sections that snapfit onto and engage, respectively, the upper surface of the range top and the inner edge surface of the corresponding opening through which the associated projections are inserted. When the clip is disposed in the latter position, the spring action of the clip permits the grate to be shifted across the range top in the direction towards the opposite opening, thereby compressing the legs under spring action and permitting the other pair of projections to be snapfitted into their corresponding opening.

Other objects, features and advantages of the invention shall become apparent from the following detailed description thereof when considered with reference to the accompanying drawings wherein like reference characters refer to corresponding parts in the several views.

DETAILED DESCRIPTION OF THE PREFERRED EMBODIMENTS

Figures 1, 2, 3, 4, 5, 6, 7:
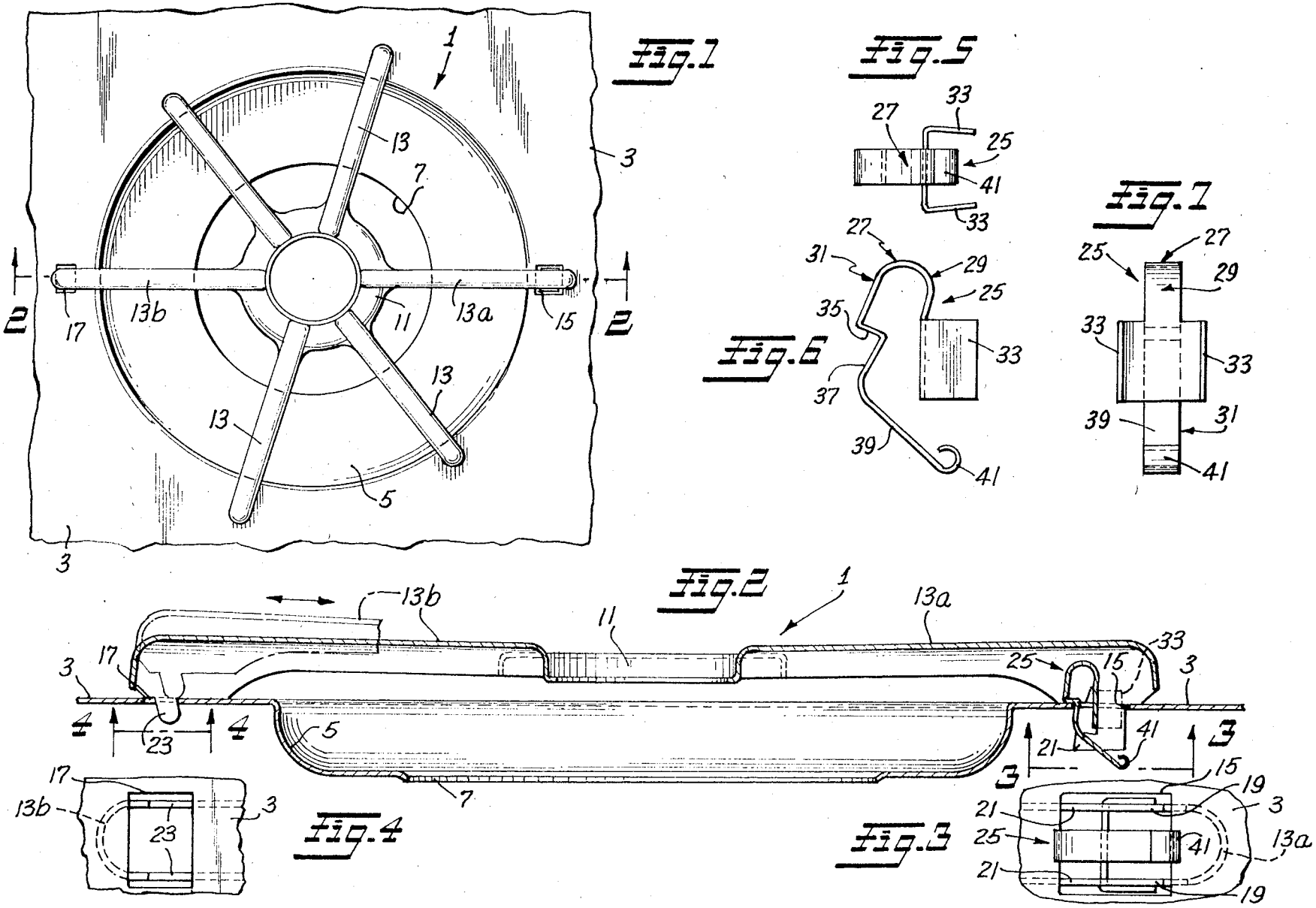
FIG. 1 is a fragmentary top plan view of a preferred embodiment of the invention showing the range grate secured in position over the burner well of a range top.
FIG. 2 is an enlarged fragmentary vertical sectional view, taken on the line 2—2 of FIG. 1, wherein the phantom lines indicate the position of the range grate either just prior to its full attachment to or just after its initial detachment from the range top.
FIG. 3 is a fragmentary bottom plan view, showing the retaining clip in its position of attachment to one pair of downwardly extending projections and inserted through one corresponding opening in the range top, taken on the line 3—3 of FIG. 1.
FIG. 4 is a fragmentary bottom plan view, showing the other pair of downwardly extending projections inserted through the other corresponding opening in the range top, taken on the line 4—4 of FIG. 2.
FIG. 5 is an enlarged plan view of a retaining clip according to a preferred embodiment of the invention.
FIG. 6 is a side elevational view of the retaining clip shown in FIG. 5.
FIG. 7 is an elevational view of the retaining clip as viewed from the right side of FIG. 6.

An improved range grate and retaining clip assembly 1, according to a preferred embodiment of the invention, shall now be described with initial reference to FIG. 1. As shown therein, a range top 3 of conventional design includes a burner well 5 provided with a burner opening 7. Well 5 and opening 7 are of corresponding circular configurations, but it is understood that assembly 1 may also be utilized in conjunction with burner wells and openings of other configurations.

Assembly 1 includes a range grate 9 having a generally circular configuration defined by a central hub 11 provided with a plurality of radially extending arms 13. Grate 9 is shown formed from sheet metal, but it is also understood that grate 9 may be formed from cast metal. Though the configuration of grate 9 conforms to the circular configuration of burner well 5, it is clear that grate 9 may assume other configurations to correspond to the configuration of well 5.

As particularly noted in FIG. 1, grate 9 includes a pair of linearly disposed arms **13*a* and 13*b* which extend outwardly from opposite sides of hub 11, whereby the terminal ends of arms 13*a* and 13*b* also extend beyond the outer periphery of burner well 5 and are disposed directly over a pair of corresponding openings 15** and 17, respectively, provided through range top 3 for a purpose to be hereinafter detailed. Similarly, the terminal ends of remaining arms 13 also extend beyond the outer periphery of well 5 for engaging the upper surface of range top 3 so that grate 9 may be supported and centralized directly over burner opening 7.

As shown in FIG. 2, the terminal end of arm 13*a* is provided with a pair of downwardly extending spaced projections 19 having a pair of inwardly directed spaced flanges 21 extending therefrom, whereby a substantially L-shaped configuration is defined by each projection 19 and its corresponding flange 21. With reference to FIG. 3, projections 19 and their corresponding flanges 21 are insertable through opening 15 of range top 3. Similarly, the terminal end of arm 13*b* is also provided with a pair of spaced downwardly extending projections 23 which are insertable through their corresponding opening 17 provided in stove top 3, as more clearly shown in FIG. 4. It is preferred that projections 23 be also angled slightly inwardly as shown in FIG. 2 in order to permit projections 23 to more securely grip against the inner edge of opening 17 and prevent their accidental dislodgement in the vertical direction.

The detachable securing of range grate 9 to range top 3 is accomplished by means of a retaining clip 25, the details of which shall now be described with reference to FIGS. 5, 6 and 7. As shown therein, clip 25 is preferably integrally formed from a single piece of spring metal, though it is entirely within the purview of the invention to form clip 25 from plural parts and other types of suitable resilient material, such as plastic. Clip 25 is defined by a U-shaped portion 27 that includes a pair of first and second legs 29 and 31 which are urgeable towards each other under spring action. First leg 29 carries a pair of spaced outwardly extending flanges 33 having a channel-shaped configuration for the purpose of attaching clip 25 to grate 9 in a manner to be later described. Second leg 31 includes a first section 35 and a second section 37, both of which are preferably planar-shaped in configuration and intersect to substantially define a right angle therebetween. Second leg 31 also includes an outwardly extending lower portion 39 which terminates in a rolled end 41 for the purpose of facilitating the insertion of clip 25 through opening 15 of range top 3.

The manner in which retaining clip 25 is attached to range grate 9 for the purpose of detachably securing grate 9 to range top 3 shall now be described with particular reference to FIGS. 2, 3 and 4. Clip 25 is first attached to grate 9 by engaging flanges 33 onto projections 19 whereby the exterior surfaces of the latter are embraced by flanges 33. It is preferred that the spacing between flanges 33 be somewhat narrower than the spacing between projections 19 so that the spring action of the material forming flanges 33 shall cause same to be securely snapped onto projections 19. As seen in FIG. 2, inwardly extending flanges 21 of projections 19 serve to prevent clip 25 from being removed from its position of engagement on projections 19 in the downward vertical direction. When clip 25 has been secured onto grate 9 in this manner, lower portion 39 of clip 25 and projections 19 are inserted as an assembly through opening 15 by first urging second leg 31 in the outward direction towards first leg 29. This causes sections 35 and 37 to snapfit into abutting engagement with, respectively, the upper surface of range top 3 and the inner edge surface of opening 15. In this position, and as apparent from FIG. 2, section 35 is disposed in a substantially horizontal position, while section 37 is disposed in a substantially vertical position. When this is accomplished, it is apparent that the terminal end of arm 13*a* has been substantially resiliently snapfitted through opening 15 by means of clip 25. In order to complete the attachment of grate 9 to range top 3, grate 9 is then shifted laterally against the spring action of clip 25 and towards opposite opening 17, thereby permitting projections 23 to be snapfitted therein. Removal of grate 9 is accomplished in the reverse manner by shifting grate 9 slightly in order to release the gripping action of projections 23 against the inner edge of opening 17. This is shown in solid and phantom lines in FIG. 2, with the double arrow indicating the opposite directions in which grate 9 may be shifted during the insertion and removal of projections 23 with respect to opening 17. The sizes and configurations of openings 15 and 17 should be such as to permit the insertion and removal of their corresponding projections 19 and 23, respectively, in the manner described herein.

It is to be understood that the forms of the invention herein shown and described are to be taken as preferred embodiments of the same, and that various changes in shape, material, size and arrangement of parts may be resorted to without departing from the spirit of the invention or scope of the subjoined claims.

I claim:

1. An improved range grate and retaining clip assembly for detachably securing the grate over the burner well of a range top, the grate including at least one downwardly extending projection means for insertion through a corresponding opening in the range top, which assembly comprises:

(a) the retaining clip being defined by a U-shaped spring portion including first and second legs urgeable towards each other under spring action;

(b) the first leg including means for attaching the clip to the projection means;

(c) the second leg including means for engaging the range top;

(d) wherein the projection means is defined by a pair of spaced projections and the means for attaching the clip to the projections includes a pair of spaced flanges for embracing the projections; and (e) wherein when the projection means and attached clip are inserted through the opening and disposed in an operative position, the grate may be shifted relative to the stove top against the spring action of the legs.

2. The improved assembly of claim 1 wherein the projection means includes a pair of inwardly directed flanges for retaining the clip in it position of attachment on the projections.

3. The improved assembly of claim 2 wherein said pair of spaced flanges for embracing the projections are outwardly directed.

4. The improved assembly of claim 1 wherein the means for engaging the range top includes first and second sections formed in the second leg, where the first section engages the upper surface of the range top and the second section abuts the inner edge of the opening.

5. The improved assembly of claim 4 wherein the first and second sections are substantially planar and intersect to form a substantially right angle therebetween.

6. The improved assembly of claim 4 wherein the second leg includes an outwardly extending lower portion which terminates in a rolled configuration.

7. The improved assembly of claim 1 wherein the clip is integrally formed from spring metal.

* * * * *